US005307741A

United States Patent [19]

Clark et al.

[11] Patent Number: 5,307,741

[45] Date of Patent: May 3, 1994

[54] IMPACT HAND STAMPING DEVICE

[75] Inventors: Emory J. Clark, Spokane; Robert J. Warner, Veradale, both of Wash.

[73] Assignee: Spring Line, Inc., Spokane, Wash.

[21] Appl. No.: 78,912

[22] Filed: Jun. 15, 1993

[51] Int. Cl.[5] ..... B41K 1/56

[52] U.S. Cl. ..... 101/405; 101/3.1; 30/367

[58] Field of Search ..... 101/3.1, 9, 28, 368, 101/405, 406; 30/366, 367

[56] References Cited

U.S. PATENT DOCUMENTS

| | | | |
|---|---|---|---|
| 833,712 | 10/1906 | Geisenhoner | 30/367 |
| 1,461,032 | 10/1920 | Forsyth | 30/367 |
| 1,887,085 | 6/1932 | Ehrlich | 30/367 |
| 1,965,814 | 7/1934 | Van Cantfort | 101/405 |
| 2,446,848 | 11/1948 | Prester | 30/367 |
| 2,455,270 | 11/1948 | Ravella | 101/3.1 X |
| 2,675,079 | 4/1954 | Hughes | 30/367 |
| 2,684,026 | 7/1954 | Randolph, Sr. | 101/405 X |
| 3,177,952 | 4/1965 | West | 101/3.1 X |
| 3,362,326 | 1/1968 | Delpo et al. | 101/405 X |
| 3,385,380 | 5/1968 | Waller | 101/3.1 X |
| 3,407,499 | 10/1968 | Rapaport | 30/367 |
| 4,127,063 | 11/1978 | Peterson et al. | 101/3.1 |

OTHER PUBLICATIONS

McMaster-Carr Company Catalog, Chicago, Ill., 1992, p. 1867.

*Primary Examiner*—Edgar S. Burr
*Assistant Examiner*—Christopher A. Bennett
*Attorney, Agent, or Firm*—Wells, St. John, Roberts, Gregory & Matkin

[57] ABSTRACT

A impact hand stamping tool 10 has an imprint member 14 with an elongated hand stamp element 16 slidably mounted in a supporting sleeve element 18. The hand stamp element extends from an anvil end 50 to an imprint end 46 having a symbol face 48. The hand impact tool 10 has a plunger member 70 with an elongated forward end 74 having an anvil surface 76 for engaging the anvil surface 52. An elongated coil spring 90 has reduced diameter spring ends 94 and 96 mounted in corresponding spring latching grooves 26 and 84, respectively. Each of the members 14 and 70 have finger gripping sections 26 and 84 that are formed with a series of annular grooves 100 forming finger rings 102 for enabling the user to easily grip and hold the tool member 14 during the operation of the tool and the expansion of the coil spring prior to the release of the plunger member 70. Upon release of the plunger member, the anvil surface 76 of the forward end 74 is driven into the anvil end 52 driving the hand stamp element 16 to imprint the work surface 12. The number of rings 102 in the finger gripping section 102 is less than the number of rings 102 of in the finger gripping section 24 to minimize premature release of the sleeve element prior to the release of the plunger member 70.

26 Claims, 4 Drawing Sheets

Fig 4
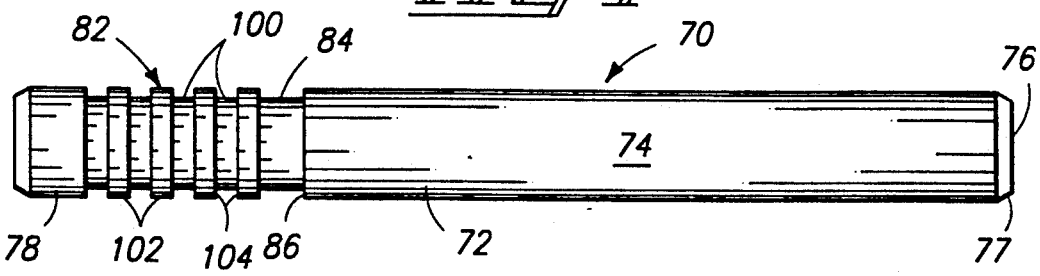
Fig 5
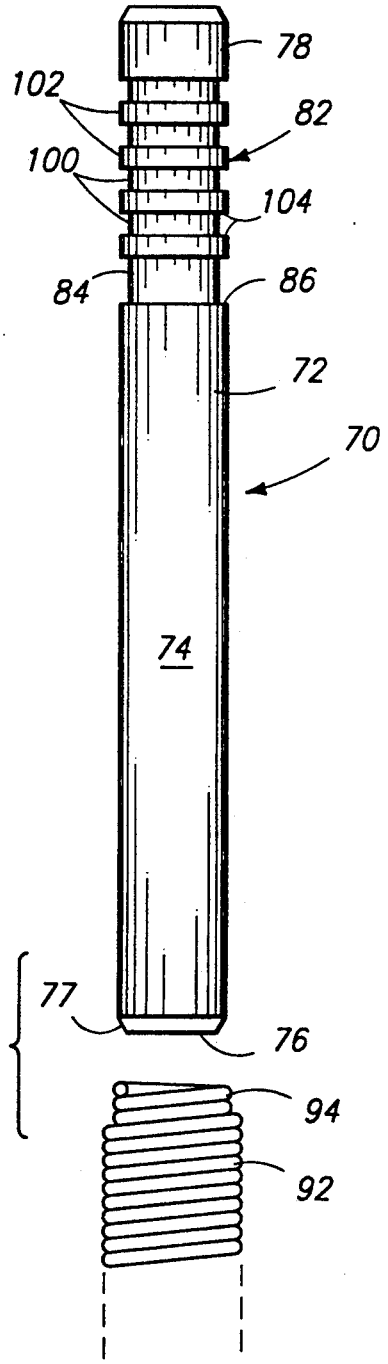
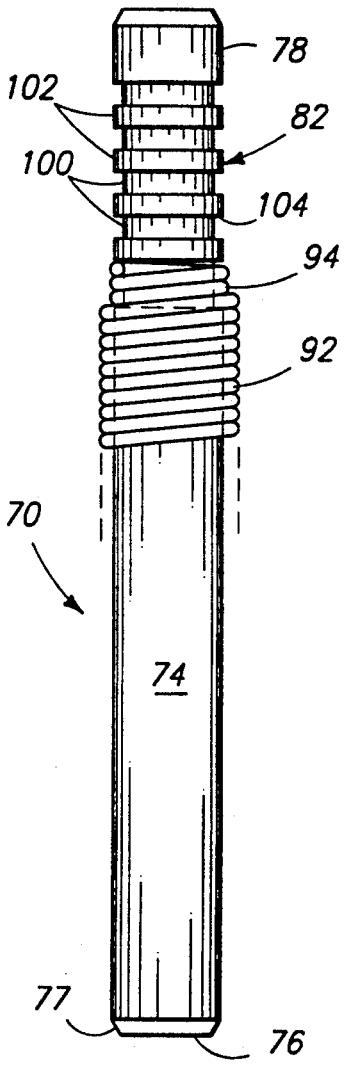
Fig 6

IMPACT HAND STAMPING DEVICE

TECHNICAL FIELD

This invention relates to impact hand stamping devices.

BACKGROUND OF THE INVENTION

Although the concept of providing impact hand tools that are spring driven has been suggested for many years, there does not appear to be an impact hand stamping tool that is safe, easy to use, inexpensive to manufacture, and has an extended wear life.

These and other advantages of this invention will become apparent upon reading the following detailed description of preferred embodiments.

BRIEF DESCRIPTION OF THE DRAWINGS

Preferred embodiments of the invention are described below with reference to the accompanying drawings, which are briefly described below.

FIG. 4 is an enlarged view of the plunger member of the tool;

FIG. 5 is an enlarged view of the plunger member and one end of the tension driving spring as the one end of the driving spring is being mounted on the plunger member;

FIG. 6 is an enlarged view similar to FIG. 5 except showing the one end of the driving spring fully mounted on the plunger member;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 12:
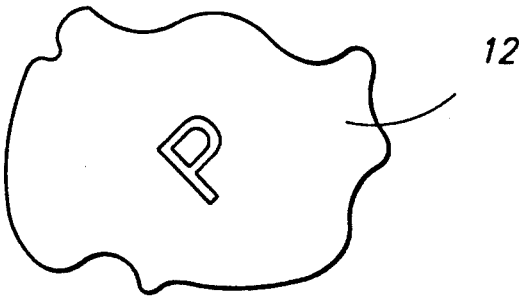
FIG. 12 is a fragmentary view of the work surface illustrating the imprinting of the character on the work surface by the use of the tool.

A preferred embodiment of the invention is disclosed in the attached drawings showing a impact hand stamping tool, generally designated with the numeral 10. The hand stamping tool 10 is designed to imprint one or more characters or symbols on a working surface 12 as illustrated in FIG. 12.

Figure 2:
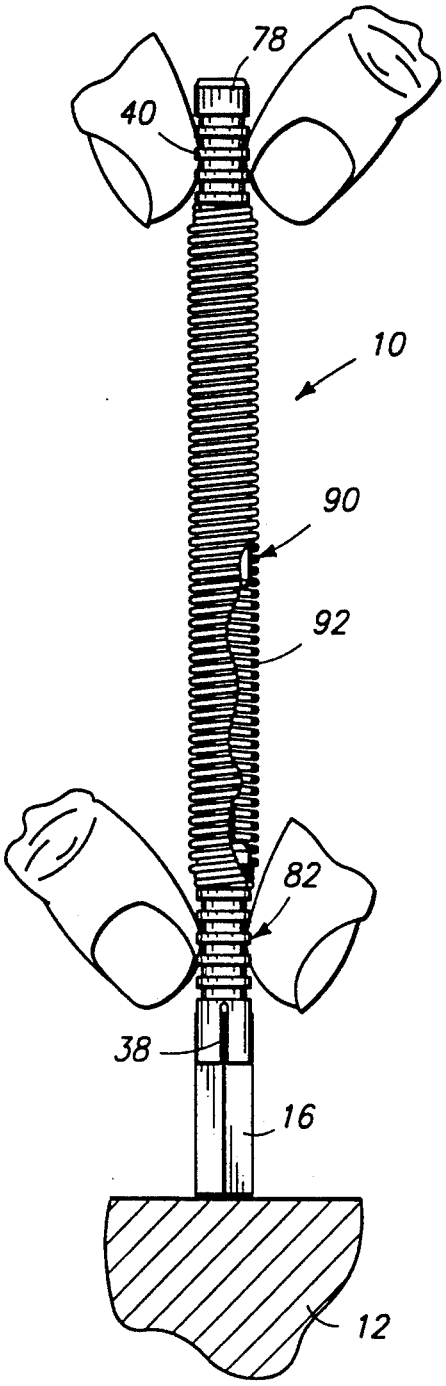
FIG. 2 is a side elevational view similar to FIG. 1, except showing the tool with the driving spring in an expanded condition ready to imprint a character onto a work surface.
Figure 9:
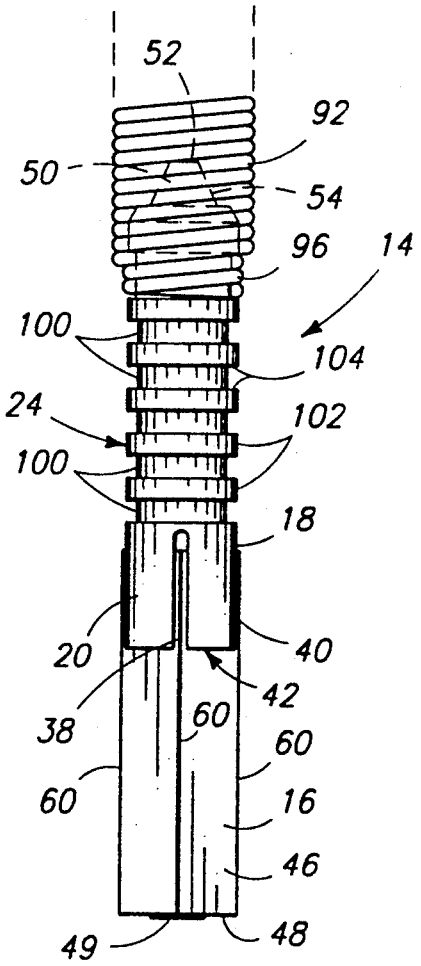
FIG. 9 is an enlarged view similar to FIG. 8 showing the opposite end of the driving spring fully mounted on the sleeve element.
Figure 10:
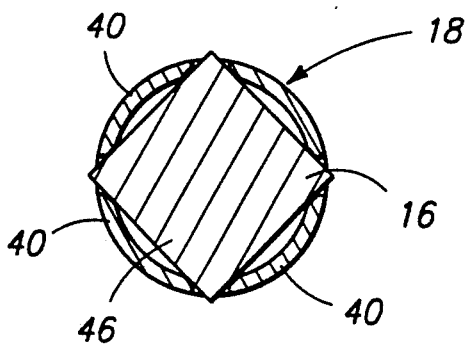
FIG. 10 is a cross-sectional view taken along 10—10 in FIG. 8.

The impact tool 10 includes an imprint member 14 (FIGS. 8-10) at one end that is placed adjacent to or engaging the work surface 12 as illustrated in FIG. 2.

The imprint 14 includes a rather elongated impact hand stamp element 16 that is slidably and releasably mounted in a supporting sleeve element 18.

The sleeve element 18 has a generally tubular sleeve body 19 that extends between a front end 20 and a rear end 22. The rear end 22 has a annular anvil surface 23.

The sleeve element 18 has a finger gripping section 24 intermediate the front end 20 and the rear end 22 for enabling a user to grip the section 24 between their thumb and fore finger to support the tool 10 with the impact hand stamp element 16 against the work surface 12.

Preferably, the maximum diameter of the sleeve element is between 0.65 cm. and 0.85 cm. Preferably, the rear end 22 has a diameter that is substantially equal to the maximum diameter of the sleeve element 18. Preferably the rear end 22 has a longitudinal length less than the maximum diameter of the sleeve element. Most preferably the rear end 22 has a longitudinal dimension of between 0.30 cm and 0.50 cm. The rear anvil surface 23 includes an anvil peripheral bevel to facilitate assembly of the tool 10.

The finger gripping section 24 has enhanced gripping interlocking friction characteristics (large coefficient of friction with respect to human fingers) to minimize the unintentional release of the sleeve element during usage.

The sleeve element 18 further includes an exterior spring latching means preferably in the form of an annular groove 26 that is formed in the sleeve element 18 intermediate the finger gripping section 24 and the rear end 22. The spring latching groove 26 forms a latching shoulder 27 in conjunction with the cylindrical rear end 22.

The sleeve element 18 has a longitudinal cylindrical bore 28 extending therethrough forming a front opening 30 in the front end 20 and a rear opening 32 in the anvil surface 23. A stepped square counterbore 34 is formed in the bore 28 at the front end of the sleeve element 18 forming an internal abutment shoulder 36.

Additionally the square counterbore 34 is of sufficient diameter to form angularly spaced elongated slots 38 in the front end 20 of the sleeve element 18. The slots 38 in turn form fingers 40 intermediate the slots 38 for frictionally, releasably gripping the hand stamp element 16. Free ends 42 of the fingers 40 are bent radially inward into the counterbore 34 to serve as leaf springs to frictionally grip the hand stamp element 16. Ends 42 of the fingers 40 have chamfered surfaces to frictionally engage the hand stamp element 16 and to easily enable one hand stamp element to be remove and another reinserted.

Figure 11:
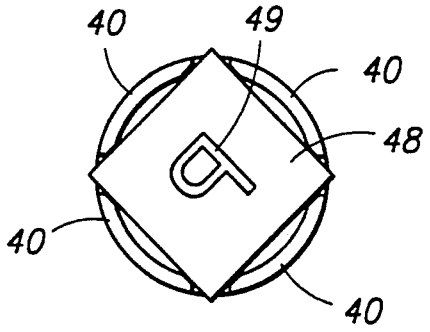
FIG. 11 is a bottom view of the imprint member illustrating an imprint character affixed thereto.

The elongated hand stamp element 16 is slidably mounted in the bores 28 and 34 and extends between an imprint end 46 and an anvil end 50. The imprint end 46 has a square cross-section corresponding to the square counterbore 34 and projects outward from the front end 20. The imprint end 46 has a symbol or character face 48 on which is mounted a symbol or character 49 to be imprinted on the work surface 12 (FIGS. 11-12).

Figure 1:
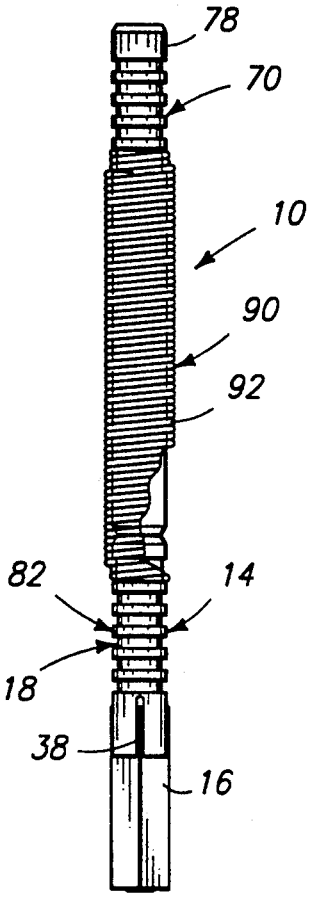
FIG. 1 is a side elevational view of a preferred embodiment of a impact hand stamping tool shown in an upright orientation with a tension driving spring in a contracted condition.
Figure 3:
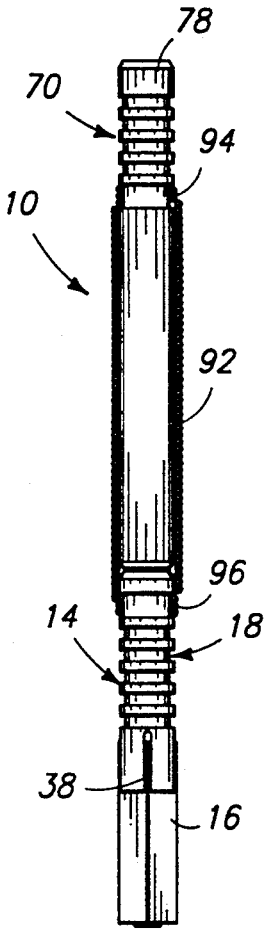
FIG. 3 is a vertical cross sectional view of the tool illustrated in FIG. 1 emphasizing an imprint member at one end and a plunger member at an opposite end.
Figure 7:
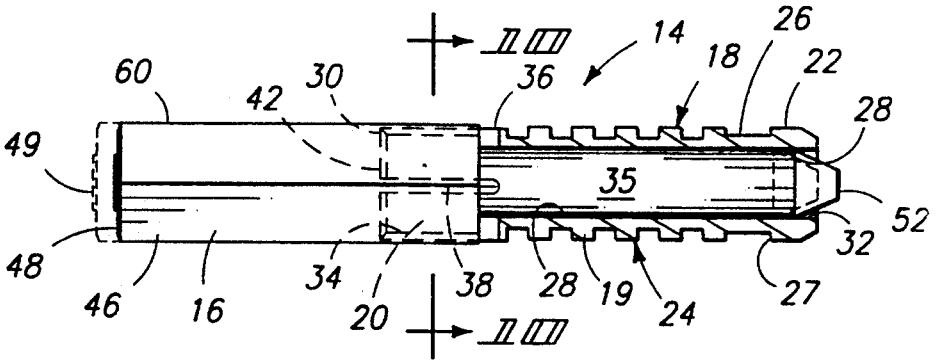
FIG. 7 is an enlarged longitudinal cross sectional view of the imprint member of the tool showing an elongated hand stamp element slidably mounted in a supporting sleeve element.

The anvil end 50 has a cylindrical cross-section corresponding to the bore 28 that has an anvil surface 52 that is flush with the anvil surface 23 of the sleeve when the tool 10 is in the retracted position as illustrated in FIGS. 1 and 3 and extends outward from the rear opening 32 as shown in FIG. 7 when the tool is in the extended position illustrated in FIG. 2. The anvil surface 52 has a beveled surface 54.

The hand stamp element 16 has a shoulder formed thereon intermediate the imprint end 46 and the anvil end 52 for engaging the abutment shoulder 36 to limit the sliding movement of the hand stamp element 16 in the sleeve element 18. The imprint end 46 with the square cross-section has corner edges 60 that project into and slide in respective slots 38.

The impact hand tool 10 has an elongated plunger member 70 (FIGS. 4–6) at the opposite end from the imprint 14. The elongated plunger member 70 has a generally cylindrical elongated plunger body 72 with a maximum diameter corresponding to the maximum diameter of the sleeve element 18. The plunger body 72 extends between a rather massive forward end 74 having an anvil surface 76 and a tool end 78. The length and weight of the plunger body 72 is greater than twice the length and weight of the sleeve element 18. The anvil surface 76 has an anvil peripheral bevel 77 to facilitate the assembly of the impact tool 10 and to facilitate efficient operation of the hand tool 10.

Preferably, the forward end 74 has a diameter corresponding to the maximum diameter of the cylindrical body 72, and most preferably has a diameter between 0.65 cm. and 0.85 cm.

The plunger member 70 has a finger gripping section 82 that is intermediate the forward end 74 and the tool end 78. The finger gripping section 82 preferably has enhanced gripping interlocking friction characteristics (large coefficient of friction with respect to human fingers). Preferably the frictional gripping characteristics of finger gripping section 82, even though large, are less than the frictional characteristics of finger gripping section 24 to minimize the possibility of the premature release of the sleeve element 18 prior to the release of the plunger member 70 when the tool is in the expanded position illustrated in FIG. 2.

The plunger member 70 further includes a spring latching groove 84 formed therein between the finger gripping section 82 and the forward end 74 forming a latching shoulder 86 in conjunction with the forward end 74.

The rather massive forward end 74 has a longitudinal length that is at least twice the longitudinal length of the rear end 22 of the sleeve element 18. Preferably, the length of the forward end 74 is between 3 cm. and 7 cm. Such an arrangement enables the tool 10 to deliver maximum application of force to the hand stamp element 16 to the work surface, while still at the same time enabling the user to exercise substantial control of the amount of force applied during any application. Consequently, the tool 10 may be used with work surface materials having a wide variance in hardness. Even more importantly, the tool can be used for imprinting characters on quite brittle materials without fracturing or cracking the materials, because the application of force is accomplished very rapidly, causing deformation of the work material without fracturing.

The hand impact tool 10 includes an elongated tension coil spring 90 that has a rather constant diameter central section 92 that extends between reduced spring ends 94 and 96. The reduced spring ends 94 and 96 comprise at least two complete 360 degree coil turns, and preferably between two and five turns. Preferably, the coil spring 90 is made from a high quality spring music wire. Preferably, the coil spring 90 has an initial pre-load or pre-tension of at least 2 oz., and preferably 1.0 to 1.5 lbs., so that the anvil surfaces 52 and 76 are maintained in engagement when the tool is not in use and to increase axial alignment of the anvil surfaces when in use.

The coil spring 90 preferably has sufficient strength to enable the spring to expand at least fifty percent of its original length upon the application of the pulling force on the plunger member 70 that is between 10 and 15 lbs. Preferably, the central section 92 has an inside diameter that is between 0.90 cm. and 1.00 cm. The inside diameter of the central section 92 is greater than the diameter of the forward end 74 so that coils of the spring 90 do not interfere with the movement of the forward end 74. Preferably, the reduced spring ends 94 and 96 have an inside diameter of between 0.50 cm. and 0.85 cm. Most preferably, the reduced spring ends 94, 96 have an inside diameter of approximately 0.66 cm. The spring music wire itself, preferably has a diameter of approximately 0.10 cm.

Preferably, the spring latching grooves 26 and 84 have a depth that is greater than one-half of the diameter of the spring wire of the coil spring 90. Preferably, the depth of the spring latching groove 26 is between 0.050 cm. and 0.080 cm.

As previously mentioned, the frictional characteristics of the finger gripping section 24 are preferably greater than the finger gripping characteristics of the section 82. Preferably, the finger gripping friction characteristics of section 24 are greater than that of finger gripping section 82 so that a person can easily maintain their grip on the sleeve element 18, and hold the symbol in engagement with the work surface 12 before the plunger member 70 is released, as illustrated in FIG. 2.

Each of the finger gripping sections 24 and 82 includes a series of spaced annular grooves 100 having a depth greater than 0.040 cm. Preferably, the depth of each of the grooves 100 is between 0.040 cm. and 0.080 cm., and more preferably between 0.050 cm. and 0.080 cm. The annular spaced grooves 100 form at least two spaced rings 102. In a preferred embodiment, the grooves 100 form annular sharp edges 104 at the sides of the rings 102 to dramatically increase the gripping friction between the user's fingers and the members 14 and 70.

It should be noted that in the preferred embodiment the finger gripping section 82 has fewer rings 102 than the finger gripping section 24 to minimize premature release of the sleeve element 18 prior to the intentional release of the plunger member 70. As illustrated in the drawing, the finger gripping section 82 has four rings 102 as compared to five rings for the section 24.

Each of the annular grooves 100 has a width that is between 1.5 and 2.5 times the depth of the grooves 80. Preferably, the width of the grooves 80 is between 0.120 cm. and 0.200 cm. Each of the rings 102 has a width that is preferably between 1.5 and 2.5 times the depth of the grooves 80. More preferably, the width of the rings 102 is between 0.120 cm. and 0.200 cm. The large frictional characteristics of the finger gripping sections 24 and 82 increase the safety in use of the hand impact tool, and additionally enables the user to quickly learn the proper distance to retract the plunger member to obtain the desired results.

Figure 8:
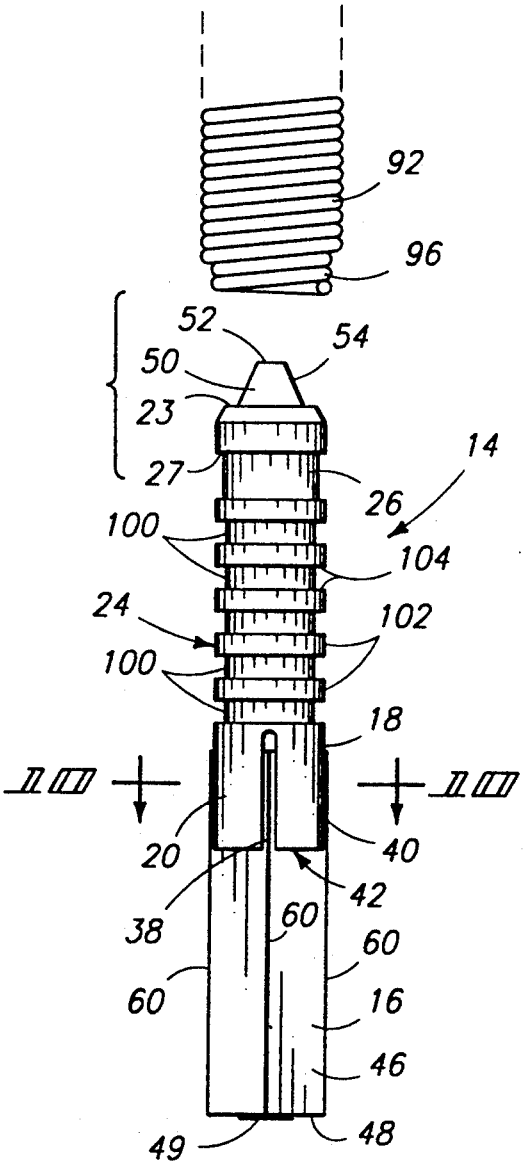
FIG. 8 is an enlarged view of the imprint member and an opposite end of the tension driving spring as the opposite end of the driving spring is being mounted on the sleeve element.

One of the advantages of the hand impact tool 10 is its ease of assembly. No special tools are required. As illustrated in FIGS. 5 and 8, the elongated coil spring 90, and particularly the reduced spring end 94, 96 are easily mounted in their respective latching grooves 84 and 26. This is accomplished by merely pushing the spring end 94 against the beveled anvil surface 76 (FIG. 5). The peripheral bevel 77 causes the reduced spring end 94 to temporarily expand so that the spring end may be slid along the full length of the forward end 74 as illustrated in FIG. 6. The reduced spring end 94 then snaps into the spring latching groove 84 for permanent attachment with one of the coil turns, firmly engaging the latching shoulder 86 for preventing the release of the reduced spring end 94 from the plunger member 70.

Likewise, the reduced spring end 96 is mounted to the sleeve element 18 by merely pushing the spring end 96 over the anvil rear end 22 until the spring end 96 snaps into the spring latching groove 26. One of the turns of the spring end 96 engages the latching shoulder 27 to prevent release of the spring end 96 from the sleeve element 18.

Use of the hand impact tool is illustrated in FIGS. 1-2. Initially, the user grips the sleeve element 18 with one hand in which a finger and thumb engages and grips the finger gripping section 24 as illustrated in FIG. 1 to position the tool on the work surface 12. After the correct position has been obtained, the user, with the thumb and index finger of the other hand, grips the finger gripping section 102 of the plunger member 70, and begins to pull the plunger member 70 away from the imprint member 14 as illustrated in FIG. 2. Such movement causes the anvil surfaces 52 and 78 to separate, and increases the tension on the spring 90. As the coil spring expands, it increases its potential energy which is converted into dynamic energy when the plunger member 70 is released. When released, the spring 90 contracts, driving the anvil surface 76 of the forward end 74 into impact engagement with the anvil surface 52, transferring the dynamic energy of the plunger member 70 to the hand stamp element 16. In this manner, a very rapid and high energy impact force is applied to the hand stamp element 16 and rapidly imprinting the work surface with the symbol 49 as illustrated in 12 without cracking or fracturing the work surface 12. Within a short period of practice, a user can easily adjust the stroke of the plunger member 70 to obtain the desired depth of the imprint.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An impact hand stamping tool for imprinting a character on an imprint surface, comprising:

a supporting sleeve element having a front end and a rear end, a front opening at said front end, a rear opening at said rear end, and a longitudinal bore extending between said front and rear ends;

an imprint member having an elongated hand stamping element slidably supported in said supporting sleeve element;

said elongated hand stamping element having an imprint end, an imprint character mounted on said imprint end, an opposite anvil end, and a first anvil surface at said anvil end;

said elongated hand stamping element being slidably mounted in the longitudinal bore of the supporting sleeve element with the forward end projecting outward from the front opening and first anvil surface extending outward from the rear opening during operation;

said supporting sleeve element having a first finger gripping section intermediate the front end and the rear end for enabling a user to grip the hand stamping tool with one hand and place the imprint character against the imprint surface;

said supporting sleeve element having a first spring latching means formed therein intermediate the first finger gripping section and the rear end;

an elongated plunger member having a cylindrical forward end, a second anvil surface at said cylindrical forward end, a plunger head end, and a plunger body extending between said cylindrical forward end and said plunger head end;

said plunger body having a second finger gripping section intermediate the forward and head ends for enabling the user to grip the plunger member with a second hand;

said plunger body having a second spring latching means formed therein intermediate the second finger gripping section and the forward end; and an elongated cylindrical tension coil spring having spring ends, and a central section surrounding the forward end of the plunger member and the rear end of the sleeve element that extends longitudinally between said spring ends; said spring ends being mounted respectively to said first and second spring latching means, in which the tension coil spring is expandable from a retracted condition to an expanded condition by the user gripping both of the finger gripping sections and pulling the members apart thus increasing the tension of the coil spring and thereafter releasing the plunger member to drive the anvil surface of the plunger member sharply against the anvil surface of the hand stamp element to rapidly imprint the character on the imprint surface.

2. The impact hand stamping tool as defined in claim 1 wherein the first and second finger gripping section have a plurality of spaced annular gripping grooves formed therein defining annular rings therebetween to enable a user to firmly grip the rings and retract the plunger member rearward a substantial distance without the users finger slipping from the finger gripping sections and prematurely releasing the sleeve element.

3. The impact hand stamping tool as defined in claim 2 wherein the gripping grooves form sharp annular ring edges to minimize unintentional release of the gripping sections.

4. The impact hand stamping tool as defined in claim 2 wherein each of the finger gripping sections have at least three spaced annular gripping grooves formed therein defining at least two gripping rings for gripping between the user's thumb and index finger.

5. The impact hand stamping tool as defined in claim 2 wherein at least one of the gripping grooves in each finger gripping section has a groove depth greater than 0.070 cm.

6. The impact hand stamping tool as defined in claim 2 wherein at least one of the gripping grooves in each finger gripping section has a groove depth between 0.070 cm. and 0.0100 cm.

7. The impact hand stamping tool as defined in claim 2 wherein at least one of the gripping grooves in each finger gripping section has a groove depth between 0.070 cm. and 0.0100 cm. and a groove width of between 1.5 and 2.5 times the groove depth.

8. The impact hand stamping tool as defined in claim 2 wherein each of the gripping grooves in each finger gripping section has a groove depth between 0.050 cm. and 0.0100 cm. a groove width between rings of between 1.5 and 2.5 times the groove depth.

9. The impact hand stamping tool as defined in claim 2 wherein each of the gripping grooves in each finger gripping section has a groove depth between 0.070 cm. and 0.0100 cm. and a groove width of between 1.5 and 2.5 times the groove depth and a ring width between grooves of between 1.5 and 2.5 times the grooves depth.

10. The impact hand stamping tool as defined in claim 2 wherein each of the gripping surfaces has at least three gripping rings spaced by the gripping grooves, in which each ring has a width of between 0.120 cm. and 0.200 cm.

11. The impact hand stamping tool as defined in claim 1 wherein the first gripping section has a greater gripping friction than the second gripping section to minimize unintentional release of the sleeve element prior to release of the plunger member.

12. The impact hand stamping tool as defined in claim 2 wherein the number of gripping grooves in the first gripping section is greater than the number of the gripping grooves in the second gripping section to provide greater gripping friction in the first gripping section than in the second gripping section to minimize unintentional release of the sleeve element prior to release of the plunger member.

13. The impact hand stamping tool as defined in claim 1 wherein the second anvil surface has a beveled outer perimeter to minimize engagement of the anvil surface with the central portion of the coil spring during use of the tool.

14. The impact hand stamping tool as defined in claim 1 wherein the plunger body has a longitudinal length that is greater than twice a longitudinal length of the sleeve element.

15. The impact hand stamping tool as defined in claim 1 wherein the forward end of the plunger member has a longitudinal length that is greater than four times a longitudinal length of the rear end of the sleeve element.

16. The impact hand stamping tool as defined in claim 1 wherein each of the spring latching means has an annular groove with a groove width sufficient to receive at least two coil turns of the corresponding spring end.

17. The impact hand stamping tool as defined in claim 16 wherein each of the spring latching grooves has a depth greater than 0.070 cm.

18. The impact hand stamping tool as defined in claim 16 wherein the coil spring has a prescribed wire diameter and wherein each of the spring latching shoulders has a depth greater than one-half of the prescribed wire diameter.

19. The impact hand stamping tool as defined in claim 1 wherein each of the anvil surfaces has a beveled perimeter sufficient to enable the forward end of the plunger member and the rear end of the sleeve element to be inserted into reduced diameter spring ends during assembly to initially expand an inside diameter of the spring ends and move through the reduced spring ends into the central section enabling the reduced spring ends to snap into the spring latching grooves.

20. The impact hand stamping tool as defined in claim 1 wherein the coil spring is pre-loaded with a initial tension greater than 1.0 lb. to hold the anvil surfaces in engagement when the coil spring is in the retracted condition.

21. The impact hand stamping tool as defined in claim 1 wherein the supporting sleeve element has a non-circular counterbore formed therein extending to the front opening end wherein the imprint end of the hand stamping element has a non-circular cross section complementary to the non-circular counterbore to prevent the hand stamping element from rotating relative to the supporting sleeve element.

22. The impact hand stamping tool as defined in claim 1 wherein the front end of the supporting sleeve element has longitudinal slots formed in angularly spaced locations to form gripping fingers for frictionally gripping the imprint end of the hand stamping element to releasably secure the hand stamping element within the supporting sleeve element.

23. The impact hand stamping tool as defined in claim 21 wherein the non-circular counterbore has a rectangular cross section and wherein the imprint end of the hand stamp element has a complementary rectangular cross section.

24. The impact hand stamping tool as defined in claim 21 wherein the non-circular counterbore forms an abutment shoulder within the bore and wherein the rectangular cross section of the hand stamp element forms a complementary shoulder for engaging the abutment shoulder to limit the longitudinal movement of the hand stamp element within the supporting sleeve element.

25. The impact hand stamping tool as defined in claim 22 wherein the fingers are spring biased inward to frictionally engage and releasably secure the hand stamp element within the supporting sleeve element.

26. The impact hand stamping tool as defined in claim 1 wherein anvil end of the hand stamping element has a beveled peripheral surface.

* * * * *